US006244535B1

(12) United States Patent
Felix

(10) Patent No.: US 6,244,535 B1
(45) Date of Patent: Jun. 12, 2001

(54) MAN-PACKABLE MISSILE WEAPON SYSTEM

(75) Inventor: Steven D. Felix, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/337,220

(22) Filed: Jun. 7, 1999

(51) Int. Cl.[7] ..... F41F 3/045; F41F 3/042
(52) U.S. Cl. ..... 244/3.16; 102/216; 89/1.816
(58) Field of Search ..... 244/3.15, 3.16, 244/3.17, 3.21, 3.24; 102/216; 89/1.816, 1.811

(56) References Cited

U.S. PATENT DOCUMENTS 3,945,588 * 3/1976 Maglio, Jr. ..... 244/3.16
4,938,434 * 7/1990 Menasha ..... 244/3.16
5,129,604 * 7/1992 Bagley ..... 244/322
5,211,356 * 5/1993 McWilliams ..... 244/3.15
5,857,644 1/1999 Kusters ..... 244/3.15
5,964,432 * 10/1999 Obkircher ..... 244/3.16

FOREIGN PATENT DOCUMENTS

5644909 * 4/1981 (JP) ..... 244/3.15

* cited by examiner

*Primary Examiner*—Stephen M. Johnson
(74) *Attorney, Agent, or Firm*—Earl H. Baugher; Gregory H. Bokar

(57) ABSTRACT

Provided is a compact, low-cost, lightweight, man-packable weapon system for engaging static and slowly maneuvering targets. In one embodiment, it may incorporate in its own backpack a compact launcher and multiple compact missiles, each weighing less than five pounds, for carry on a soldier's back. The missile itself uses a strapped-down acquisition and tracking sensor electrically connected to a simplified guidance system interfaced with an aero-control section capable of altering the flight path of the missile to a target. A solid-propellant rocket motor provides sufficient power to propel the missile at a predetermined limited speed and over a pre-determined limited distance that enables the proper operation of the simplified guidance system. A method for deploying a man-packable weapon system is disclosed also.

20 Claims, 1 Drawing Sheet

MAN-PACKABLE MISSILE WEAPON SYSTEM

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to a portable missile system. More particularly, the present invention is a low cost, light weight, man-packable guided missile useful militarily at the squad level. Most particularly, the missile system provides a soldier carried missile system useful against stationary and/or slow moving targets.

2. Brief Description of the Related Art

Missile weapon systems used in warfighting are generally classified as unguided weapons and guided weapons. Unguided weapons propel a projectile that follows a ballistic trajectory in the direction the weapon is fired. The accuracy of the unguided weapon may be degraded by poor aim, poor range estimates, wind, and the movement of the target. Flight path corrections of the projectile are not possible after the weapon is fired. Unguided weapons tend to be relatively inexpensive, but have a correspondingly low probability of impacting a target. Examples of unguided weapons include bullets, high explosive grenades, and bombs. A single soldier can often carry many rounds of this type of ammunition. Rocket propelled unguided weapons, such as rocket propelled grenades, generally contain an airframe, ordnance having safe and arm, contact fuse, warhead detonator, warhead, rocket motor and rocket motor initiator.

Guided missile weapons have historically been both expensive and heavy in comparison to unguided weapons. The expense of the guided weapons generally limits the weapon's use to defense or attacking high value targets. Examples of high value targets include tactical aircraft, tanks, armor, or structures having command and control functions. When guided weapons are used against trucks, jeeps, machine gun emplacements or other low cost targets, the weapons tend to cost more than the target. Additionally, a guided missile tends to be so heavy that it is tactically inefficient for use by individual soldiers. Cost and size make guided missile systems impractical for squad-level combat operations.

Guided missile systems historically have required a high performance rate, including high "hit" probabilities such as 98% or more. The large launch platform requirements of the weapon, as well as the complexity and cost of the guided missile systems, cause the launching of the guided missile to operationally monopolize significant preparation and launch times of major combat assets, such as aircraft, submarines, land complexes, or ships, when firing the missile. By requiring these significant combat assets to become engrossed in the firing of the guided missile, the reliability of the guided missile becomes paramount.

Guided missiles typically include transparent domes used as covers in the front of the missile to collect reflected or generated energy from a target, enabling the missile to track the target. The dome has a required size to achieve a minimally required total field of regard (TFOR) that includes the entire angle "seeable" by the sensor moving to the limits of the sensor gimbals. The sensor optical system focuses the electromagnetic energy received through the transparent dome in a manner similar to the functions of the lenses on a 35 millimeter photographic camera. The focal plane array within electro-optical systems receives the focused energy from the sensor optical system and converts the energy into an analog voltage that is eventually viewed as an image, similar to a television image. This is accomplished by the focal plane array clock drive and readout electronics controlling the focal plane array and converting the voltage into digital data that contained the image of the target. The gimbal system supports the sensor in a manner to provide vibration isolation and stabilization, and an additional look angle to the focal plane array. The additional look angle allows the system to center the target in the focal plane array's field of view for ease of tracking, enabling the sensor to track and hit moving targets. Motion sensors measure the position, rate, and accelerations of the missile environment, with the measurement used by a guidance control system to determine the true movement of the target and compensate for the target movement in the flight path of the missile to allow the missile to hit the target.

In view of the foregoing, there is a need for a man-packable readily replaceable guided missile system. The present invention addresses this need.

SUMMARY OF THE INVENTION

The present invention includes a low-cost, lightweight, man-packable missile, comprising a guidance system having an aerocontrol section capable of altering the flight path of the missile to a target, a computer hardware package and algorithm capable of adjusting an aerocontrol section in relation to measured values, a strapped-down acquisition and tracking sensor electrically connected to the computer hardware package for processing an algorithm, the sensor capable of providing a measured value to the computer hardware package contact-actuated ordinance section; and, a solid-propellant rocket motor of sufficient power to project the missile at a speed and over a distance that enables the guidance system.

The present invention also includes the above described man-packable missile in a man-packable missile system.

Additionally, the present invention includes a method of deploying a man-packable missile system comprising the steps of loading into a launcher a man-packable missile comprising a guidance system having an aerocontrol section capable of altering the flight path of the missile to a target, and a computer hardware package for processing an algorithm capable of adjusting an aerocontrol section in relation to measured values, a strapped-down acquisition and tracking sensor electrically connected to the computer hardware package, the sensor capable of providing a measured value to the computer hardware package and algorithm, a contact-actuated ordinance section, and, a solid-propellant rocket motor of sufficient power to project the missile at a speed and over a distance that enables the guidance system; acquiring a target wherein the sensor fixes on the target; and, firing the missile wherein the rocket motor propels the missile in the direction of the target.

DETAILED DESCRIPTION OF THE PREFERRED EMBODIMENT

Figure 1:
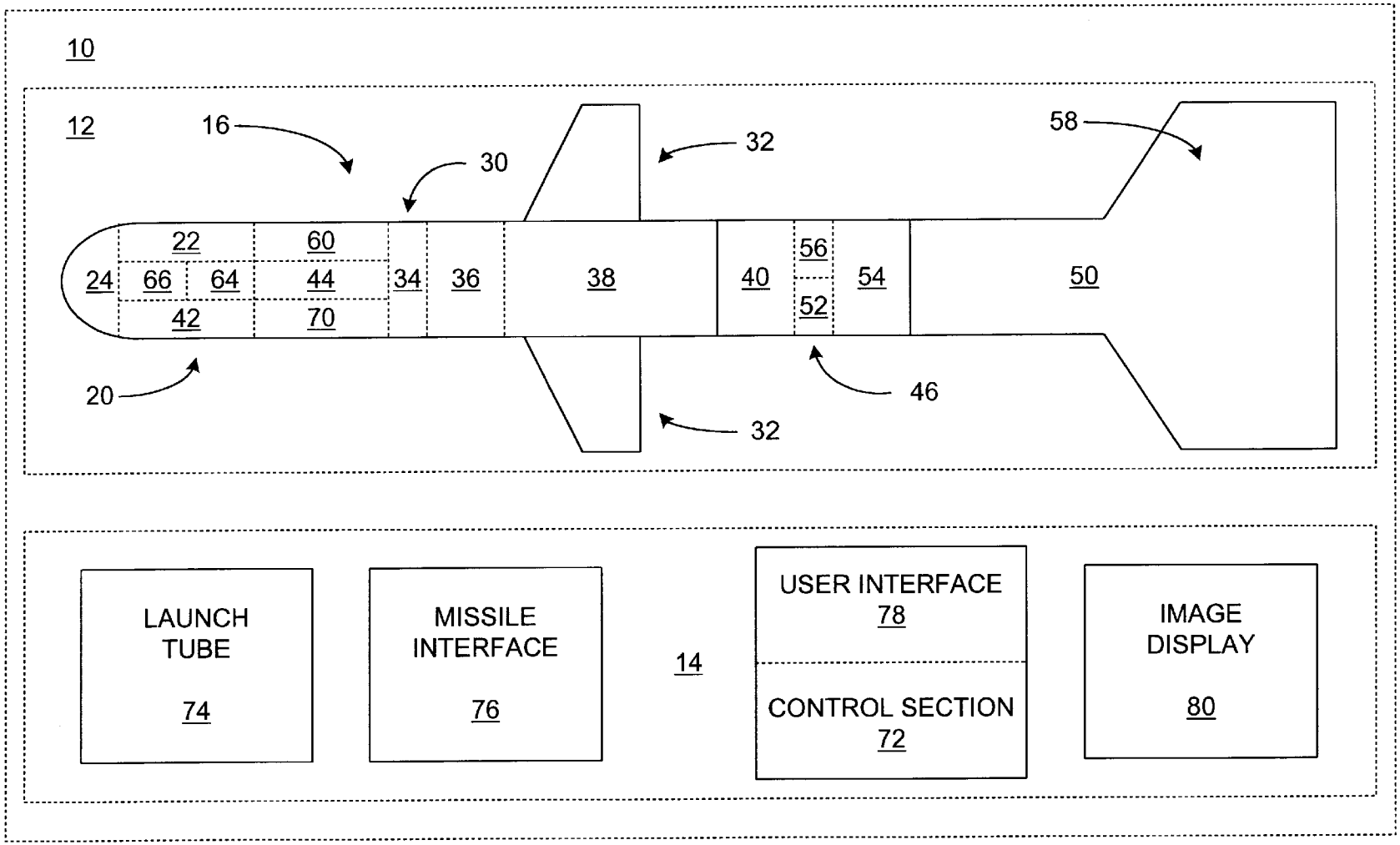
FIG. 1 is a diagram of a preferred embodiment of the missile system of the present invention showing different components thereof.

The present invention is a low-cost, lightweight, man-packable guided missile. The light-weight missile is easily transported by an individual. When incorporated into a missile system, the missile is launched from a launcher that also is man-packable. The guided missile provides the advantages of an inexpensive portable unguided weapon with the advantages of a flight corrective guided missile useful against both stationary and moving targets.

The present invention optimizes design characteristics of a missile system to include airframe, optics, target tracking sensor, guidance control systems (GCS), ordnance, rocket motor, algorithms, signal processing hardware, and power supply to provide a readily replaceable, low cost, low flight velocity, low divert G, light-weight, guided missile. The systems design approach for the man-packable missile of the present invention incorporates variations and replacements for guided missile components that permit interdependent operations for the present invention. With a general purpose target acquisition system that is not tightly tuned to a particular target signature, any visible stationary or slow moving target may be acquired and attacked. Complex systems of previously known missile systems have been removed or converted including the gimbals, the proximity fuse, the rate and acceleration sensors, the signal processing hardware, the focal plane array, and the optics.

The simplified missile system of the present invention minimizes the size and weight of the missile while producing "adequate" performance. The present invention reduces the need for near perfect system effectiveness, to about 80% or more "hit" probability, while obtaining practical operational weight and size characteristics. Squad-level combat use becomes readily available with the readily replaceable missiles from factors such as low weight, small size, and reduced cost. The availability allows the guided missile of the present invention to be used against a wider range of targets, at increasing ranges and lower risk to the warfighter. The low cost, light weight, man-packable, guided missile system of the present invention minimizes the performance specifications of the missile to tactical squad-level use, allowing the elimination of many of guided missile components previously required in the art.

FIG. 1 is a diagram of the missile system 10 of the present invention. The man-packable missile system 10 includes a missile 12 and launcher 14. The launcher 14 preferably fires a single missile 12, and is reloaded with a second missile after firing. Average reloading times should be short, such as from about one minute or less. The term "man-packable" is used within the art to describe the ability of an individual, such as a soldier or ordnance technician, to transport the missile system 10 without significant degradation of other functions, such as full-pack transit over rough terrain. This includes the ability to pack or store the missile 12 with other combat gear for the transit, i.e., the man-packable size and weight permit a single soldier to conveniently carry a launcher and from about 7 to about 10 missiles. Historically, man-packable systems allowed a single soldier to carry a launcher and one missile.

The missile 12 of the present invention has an airframe 16 that encloses a strapped-down acquisition and tracking sensor 20, a guidance and control system (GCS) 30 including an aerocontrol section 34, an ordnance section 46 having a contact-actuated warhead 40, and a solid-propellant rocket motor 50. The weight of the missile 12 allows convenient carrying of the missile 12 by an individual, preferably being sufficiently light for multiple missiles 12, preferably from about 20 missiles or less, more preferably from about 5 to about 15 missiles, and most preferably from about 7 to about 10 missiles to be carried by a single individual. The weight of the missile 12 preferably ranges from about 8 pounds or less, more preferably from about 6 pound or less, still more preferably from about 2 pounds to about 6 pounds, and most preferably from about 3.5 pounds to about 4.5 pounds.

The airframe 16 permits stabilized and corrective flight of the missile 12 to a target. The size of the airframe 16 is suitable for carrying by an individual, preferably a soldier in combat operations. The airframe 16, which may include canards 32 and a tail section 58 is designed to provide a stable air platform to carry the ordnance section 46 having the warhead 40 to the target. Preferably, the airframe 16 comprises a length of from about 22 inches or less, more preferably from about 20 to about 12 inches, and most preferably from about 18 to about 14 inches. The diameter of the airframe 16 also accommodates suitable transport by an individual, preferably ranging from about 2.5 inches or less, more preferably from about 2 inches to about 0.5 inch, and most preferably from about 1 inch to about 1.6 inch. The airframe 16 comprises any suitable light weight composition that provides a sufficiently rigid structure, such as light metal, fiberglass, plastics and/or other compositions, and combinations thereof. Examples of the compositions include aluminum, reinforced plastics, etc. with aluminum being preferred. The minimal vibration of the airframe 16 during flight aids in attaching a strapped-down focal plane array (FPA) 22. For example, a 40 mm (1.6") diameter, 46 cm (18") length low weight missile 12 is sufficiently stable to support a functionally adequate strapped-down FPA 22. Additionally, the airframe 16 includes aerocontrol surfaces (canards) 32 within the aerocontrol section 34 along the length of the airframe 16 that may include tail 58 and additional wing sections. Preferably, the aerocontrol surfaces 32 include from about 2 to about 4 canards, and more preferably from about 3 to about 4 canards.

The acquisition and tracking sensor 20 of the present invention includes components of reduced complexity and weight for identifying a target. The complex arrangement previously found in guided missile systems that included such components as a transparent dome, sensor optical system, a focal plane array, focal plane array clock drive and readout electronics, and motion sensors are replaced within the present invention. In the present invention, the optics 24 of the sensor 20 comprise a molded plastic to reduce weight. Examples of the molded plastic includes the soft plastic optics used in throwaway photographic cameras, or other transparent surface suitably light weight. As the missile 12 remains protected until fired, the reduction in durability of the optics 24 caused by using the relatively soft plastic optics 24 is not problematic. Additionally, optical quality degradation from the soft plastic remains acceptable. As the missile 12 is used in squad-level tactical situations, the operator acquires a target in the center of the "field of view", eliminating the image flatness requirements for the edges of the image.

The sensor 20 comprises an electro-optical component, such as those similar to the visible/shortwave infrared (SWIR) staring focal plane array. Preferably, the target tracking sensor comprises a single visible/SWIR spectral band staring focal plane array with approximately 640×480 pixels, such as those commonly used in camcorders, comprising a silicon charge-coupled device (CCD) or complimentary-metal-oxide-semiconductor (CMOS) FPA 22. This reduces weight and cost while maintaining acceptable functioning of the missile 12. Unlike infrared focal plane arrays, the image quality of the visible spectrum silicon FPA 22 removes the necessity for non-uniformity calibration. This reduces hardware weight, costs and signal processing complexity.

The focal plane array 22 of the present invention operates at a low frame rate sufficient for target identification. Frame rates preferably comprise a speed of from about 15 Hz or less, as compared to 60 Hz for commercial television. The low frame rate is possible because of the combination of threat target set, the low divert G and flight velocity airframe of the present invention. Low divert G is generally less than 10 G of lateral acceleration. The threat target set comprises stationary or slow moving targets. Slow moving targets include straight line travel at a speed of from about 60 mph or less, with direction changes from about 2 g's or less. The low target maneuver capability permits the present invention to incorporate a correspondingly low maneuver performance, such as a speed of from about 500 mph and 4–8 g's, or less, of divert capability. The data update rate, or the focal plane array frame rate, remains correspondingly low due to the low target maneuverability. The low frame rate reduces signal processing throughput requirements within the present invention by a factor of from about 6 to about 20 over high performance guided missile systems, reducing the weight and size requirements of a signal processing hardware package 60 sufficiently to be included in the volume available within the airframe 16.

The present invention does not utilize the gimbal system found in other guided missiles used to stabilize target tracking sensors. Gimbal systems perform several functions: to isolate the target tracking sensor from the airframe motion, to keep the target in the field of view while allowing the missile to generate an angle of attack, and to keep the target in the field of view while allowing the missile to generate the potentially large angle between the direction the sensor must point to view the target and the direction the missile must point required to implement proportional navigation guidance law. However, the focal plane array 22 based target tracking sensor 20 of the present invention is mounted directly onto the airframe 16 structure and not on a gimbal. The non-gimbal approach of the present invention comprises a "strapped down" focal plane array 22.

Gimbal systems provide image vibration isolation from airframe movement. High frequency vibrations of the airframe form an image smear, degrading the image and significantly reducing system performance. Within the present invention, the vibration is mitigated by a short and rigid airframe 16 that limits the bending modes of the airframe 16, reducing any disruption in the proper operation of the target tracking sensor 20. Additionally, the focal plane array 22 containing integration time control of the present invention controls image smear by shortening the integration time.

The present invention flies along a flat fly-out trajectory. The lack of look angle capability of the present invention also removes the need for a gimbal mounted focal plane array. A lofted trajectory approach required for long range capability, requires a fired missile to "look down" at the target. Incorporating a flat fly-out trajectory in the short range missile 12 of the present invention removes the necessity of a gimbal system.

Guided missile systems have generally used a navigation law of proportional navigation. As such, the guided missile predicted an intercept point in space to fly toward rather than continually chasing the target. The relative speeds of the missile and target determined the line of sight angle that the gimbal must turn to keep the target in the field of view (POV). For non-maneuvering targets the equation becomes correctly solved, and for maneuvering targets, the targets become increasingly stationary in the FOV as the missile decreases its range to target. Accordingly, at the end of missile flight, called the "endgame", few divert Gs were required. The present invention, however, does not implement a proportional navigation solution during all phases of flight as the lack of gimbals prohibits the missile 12 from pointing beyond the edge of the FOV. The lower performance guidance law causes modified pursuit where the missile 12 flies a non-optimum flight trajectory to the target. At the end of missile 12 flight of the present invention, the missile 12 may have to pull more g's than required in an optimized flight path. The guidance control system 30 corrects the flight path of the missile 12 in amount of from about 15 degrees or less.

The resultant performance limitations of the present invention with the removal of a normally used gimbal system is managed with a lower performance guidance, a flat fly-out trajectory, and the loss of image vibration isolation. The strapped down focal plane array 22 removes the cost, complexity, size, and weight of the gimbal system, as well as removing the packaging problems related to mounting the focal plane array 22, the focal plane array drive circuitry, and the A/D converter on the gimbal. The lack of space on the gimbal to mount the support circuits, and problems of drive circuitry and A/D converter being placed off gimbal are resolved with the removal of the gimbal system. The small size of the airframe 16 and non-dynamic threats in the target set also make the removal of the gimbal possible.

The guidance and control system (GCS) 30 directs the missile 12 to the target. The guidance and control system 30 performs real-time in-flight weapon aim-point corrections from measurements collected by the sensor 20. Aim-point corrections are performed by changing the missile flight trajectory with aerocontrol surfaces 32 of the airframe 16 during the period of flight. The aim-point corrections dramatically improve the probability of impacting the target over unguided missiles and allows the missile 12 to be used at longer ranges. Generally the GCS 30 has a computer 44, an aerocontrol section/autopilot 34, aero-control surface position sensors 36, aero-control surface servos 38, and a launcher interface 42. The GCS 30 computer 44 processes the measurements from the focal plane array 22 to locate and track the target. The autopilot 34 of the GCS 30 comprises a program that converts target measurements and corrects the flight direction of the missile 12 to intercept the target. As aero-control surface position sensors 36 measure the position of the aero-control surfaces 32 for the autopilot 34, the autopilot 34 commands the aerocontrol-surface servos 38 to generate a torque on the aero-control surfaces 32 to alter the flight path of the missile 12. Prior to missile 12 launch from the launcher 14, the launcher interface 42 of the GCS 30 provides a communications link between the missile 12 and the launcher 14 with power-up, acquire, and launch command information passed across the communications link. The GCS 30 of the present invention uses solid state rate and acceleration sensors 66 (MEMS technology) to replace classical gyros. These small, low power and inexpensive motion sensors reduce the size and weight requirements of the missile 12. Low performance aspects of the solid state sensors 66 may be calibrated by higher performance sensors (not separately shown) within the control section 72 in the launcher 14. The launcher 14 further comprises a launch tube 74 that focuses the rocket motor 50 plume (not separately shown) away from the operator providing thermal protection. The launch tube 74 also supports the missile 12 prior to launch and during the initial stages of launch. Additionally, the launcher 14 has a missile interface 76 that transfers information, such as images, from the missile 12 to the launcher 14 for the operator to designate the target. The missile interface 76 also transfers command and control data from the launcher 14 to the missile 12. A user interface 78 of the launcher 14 allows the operator to pass information to the missile 12, such as launch commands through a trigger and control buttons, and for the operator to receive images received by the launcher 14 from the missile 12. The operator "sees" the image through an image display 80 showing the image as seen by missile 12 with additional information of a track box (not separately shown) that indicates to the operator the missile 12 acquisition and mode status of the missile 12.

Ordnance section 46 within the missile 12 may be designed for specific purposes. Preferably the ordnance section 46 comprises a safe & arm (S&A) 52, a contact fuze 54, warhead detonator 56, and a warhead 40. The safe & arm 52 prevents the warhead 40 from detonating before the missile 12 acquires a safe distance from the shooter. The contact fuze 54 determines missile 12 impact on the target, and the time to detonate the warhead 40. The warhead detonator 56 is a small pyrotechnic device that explodes to set off the larger charge in the warhead 40. The warhead 40 is the explosive charge that maybe designed to explode in a shaped fashion or to generate a cloud of high velocity metal fragments from the casing. Proximity fuses are not used, thus, decreasing the complexity, size and weight of the missile 12.

The rocket motor 50 of the present invention produces sufficient thrust to generate a desired speed of missile 12 flight. Preferably, the rocket motor 50 generates from about 850 mph or less of sustained missile 12 velocity, more preferably from about 500 mph to about 850 mph. The low velocity rocket motor 50 is functionally adequate against stationary and/or low velocity targets traveling from about 60 mph or less with target maneuverability of less than about 2 g's. Examples of fabrication material used for the rocket motor 50 of the present invention include a 1 or 2 pound light weight carbon fiber rocket motor casing. Preferably a minimum smoke solid-propellant is used to minimize the operator's vulnerability.

The present invention comprises minimal algorithm 64 complexity due to throughput afforded by the limited signal processor hardware that can be packaged in such a small space. Several factors reduce algorithm 64 complexity. First, the soldier firing the missile 12 first identifies the target, removing the requirement for the missile 12 system to autonomously acquire dim, point source targets. Second, the algorithm 64 complexity is reduced by the soldier performing target acquisition, i.e., placing a target acquisition box over the target and commanding the missile 12 to acquire the target through the same image. Only after the missile 12 acquires the target is the missile 12 fired. Third, the resolved targets allow the use of 2-D edge detection operators to maintain the track point, i.e., the missile system 10 only processes a small region around the target since the target and the missile 12 are slow moving. Fourth, the flat fly-out trajectory eliminates the need for the algorithms 64 to process changes in target aspect angle due solely to a lofted trajectory. The sensor 20 inputs target image measurements to the algorithm 64.

Signal processing hardware 60 throughput requirements are determined by the class of algorithms 64 implemented and the target and missile 12 dynamics. Both the class of algorithms implemented and the target and missile 12 dynamics are limited to minimize size and weight requirements. The signal processing hardware 60 requirements are minimized by having a soldier perform several of the target acquisition processes, by requiring bright extended targets, and by restricting the airframe 16 performance through selection of the appropriate targets. Preferably, the algorithms 64 are performed by a single ASIC based front end filter chip (not separately shown) and either one or two general purpose Motorola microprocessors (not separately shown) for the tracker 22. The digital electronics (not separately shown) preferably low voltage devices, preferably use from about 2.3 volts to about 3 volts, to limit power consumption. The signal processing hardware 60 preferably is limited to 1 or 2 commercial-off-the-shelf (COTS) microprocessors (not separately shown).

The power supply 70 of the present invention may include any energy source that permits the proper functioning of the missile 12. Preferably, the energy source comprises a battery having lifetime of from about 30 seconds power or more, more preferably from about 30 seconds to about 60 seconds, and most preferably from about 45 seconds to about 60 seconds. High cost lithium thermal batteries used in conventional designs may be replaced with cheaper lithium ion batteries. Power requirements are reduced with the power limited requirements of the signal processing hardware 60.

The cost of the missile 12 of the present invention is sufficiently low that a defective missile 12 would be thrown away. Cost of the airframe 16 may be as low as $2. Power sources 70 may cost approximately $50, with the small rocket motor 50 size and relatively low performance also decreasing the cost of the missile 12. The overall cost of the missile system 10 of the present invention ranges from about 5% to about 10% of the cost of currently used guided missile systems. As such, the missile 12 of the present invention may be extensively used at a tactical squad-level for combat operations.

EXAMPLE 1

Seven man-packable guided missiles of the present invention, designated as Spike, are manufactured. Each spike has a 1.57 inch diameter, length of 19 inches, and 4 LB electro-optical staring focal plane arrays. Each Spike weighs approximately 4.5 pounds. A single soldier easily carries the seven missiles in a backpack (not separately shown) with a launcher 14 in addition to other combat gear over rough terrain.

The foregoing summary, description, example and drawing of the invention are not intended to be limiting, but are only exemplary of the inventive features which are defined in the claims.

What is claimed is:

1. A compact man-packable weapon system, comprising:

a compact launcher;

at least one compact missile weighing less than eight pounds, incorporating:

a simplified guidance system having:

an aero-control section that may alter a flight path of said missile to a target, a simplified computer hardware package operably connected to said aero-control section, to process a simplified algorithm for adjusting said aero-control section in relation to at least one measured value, a strapped-down acquisition and tracking sensor operably connected to said simplified computer hardware package, wherein the sensor provides said at least one measured value to said simplified computer hardware package;

a solid-propellant rocket motor, wherein said motor projects said missile at a pre-determined limited speed and over a pre-determined limited distance, thus enabling proper operation of said simplified guidance system; and a contact-actuated ordnance section that may be positioned between said guidance system and said rocket motor in said missile.

2. The weapon system of claim 1, wherein each of said at least one missiles may be of a length up to 22 inches.

3. The weapon system of claim 2, wherein each of said at least one missiles may be of a length between 12 inches and 20 inches.

4. The weapon system of claim 1, wherein each of said at least one missiles may weigh up to 6.0 pounds.

5. The weapon system of claim 4, wherein each of said at least one missiles may weigh between 3.5 pounds and 4.5 pounds.

6. The weapon system of claim 1, wherein said strapped-down acquisition and tracking sensor may be an imaging electro-optical component.

7. The weapon system of claim 6, wherein said imaging electro-optical component may incorporate an optical element of molded plastic.

8. The weapon system of claim 1, wherein said aero-control section incorporates 2 to 4 canards.

9. The weapon system of claim 8, wherein said aero-control section incorporates 3 canards.

10. The weapon system of claim 1, wherein said aero-control section further comprises a tail section.

11. The weapon system of claim 1 further comprising a configuration that allows a person to carry said weapons system hands-free.

12. A method of employing a compact man-packable weapon system incorporating a simplified guidance system, a compact launcher, and at least one compact missile, each said compact missile weighing less than eight pounds, comprising:

providing a configuration that allows said weapon system to be carried comfortably and hands-free by a person;

removing said compact launcher and one said compact missile from said configuration;

loading into said compact launcher one of said compact missiles incorporating:

a simplified onboard guidance system having an aero-control section for altering a flight path of said compact missile, a simplified computer hardware package for processing at least one simplified algorithm for adjusting said aero-control section in relation to at least one measured value, a strapped-down acquisition and tracking sensor operably connected to said simplified computer hardware package, wherein said strapped-down acquisition and tracking sensor provides said at least one measured value to said simplified computer hardware package, a contact-actuated ordnance section, and a solid-propellant rocket motor of sufficient power to project said compact missile at a predetermined limited speed and over a predetermined limited distance, thus enabling proper operation of said simplified guidance system;

identifying a target;

acquiring said identified target whereupon said strapped-down acquisition and tracking sensor fixes on said acquired identified target; and, launching said compact missile wherein said rocket motor propels said compact missile towards said acquired identified target.

13. The method of claim 12, wherein said identification and acquisition of a target is accomplished by an operator viewing an image that may include a target that the simplified guidance system may use to track and identify parameters of said imaged target to said strapped-down acquisition and tracking sensor so that said strapped-down acquisition and tracking sensor may fix on said acquired identified target.

14. The method of claim 12, wherein said strapped-down acquisition and tracking sensor inputs said imaged target measurements to be employed in said simplified algorithm.

15. The method of claim 12, further comprising reloading said compact launcher with one of said compact missiles.

16. The method of claim 15, further comprising launching at least one successive said compact missiles less than 1 minute apart from at least one prior launch from said compact launcher.

17. The method of claim 12 wherein said simplified guidance system is limited to altering a flight path of said compact missile by a maximum of 15 degrees.

18. The method of claim 12, wherein said compact missile is limited to sustained velocities up to 850 mph.

19. The method of claim 18, wherein said compact missile is limited to a sustained velocity between 500 mph and 850 mph.

20. The method of claim 12, wherein said acquired identified target moves at less than 60 mph with direction changes that incur less than 2 G's of force.

* * * * *